United States Patent [19]

Shibata et al.

[11] Patent Number: 4,775,866

[45] Date of Patent: Oct. 4, 1988

[54] TWO-FREQUENCY SLOTTED PLANAR ANTENNA

[75] Inventors: Yoshihisa Shibata, Kariya; Hiroshi Mizuno, Nagoya, both of Japan

[73] Assignee: Nippondenso Co., Ltd., Kariya, Japan

[21] Appl. No.: 863,939

[22] Filed: May 16, 1986

[30] Foreign Application Priority Data

May 18, 1985 [JP] Japan ..... 60-104955

[51] Int. Cl.[4] ..... H01Q 1/38

[52] U.S. Cl. ..... 343/700 MS; 343/725; 343/729; 343/767

[58] Field of Search ..... 343/700 MS, 727, 725, 343/729, 767

[56] References Cited

U.S. PATENT DOCUMENTS

| | | | |
|---|---|---|---|
| 3,818,490 | 6/1974 | Leahy | 343/727 |
| 3,864,690 | 2/1975 | Pierrot | 343/872 |
| 3,971,032 | 7/1976 | Munson et al. | 343/700 MS |
| 4,162,499 | 7/1979 | Jones, Jr. et al. | 343/700 MS |
| 4,197,545 | 4/1980 | Favaloro et al. | 343/700 MS |
| 4,691,206 | 9/1987 | Shapter et al. | 343/700 MS |
| 4,692,769 | 9/1987 | Gegan | 343/700 MS |

FOREIGN PATENT DOCUMENTS

| | | | |
|---|---|---|---|
| 0188345 | 7/1986 | European Pat. Off. | 343/700 MS |
| 56-141605 | 11/1981 | Japan . | |
| 58-54703 | 3/1983 | Japan . | |

*Primary Examiner*—William L. Sikes
*Assistant Examiner*—Doris J. Johnson
*Attorney, Agent, or Firm*—Cushman, Darby & Cushman

[57] ABSTRACT

A two-frequency planar antenna incorporates a resonant antenna and a slot antenna which are arranged in a superposed manner on the same dielectric substrate so as to be operable independently without interfering with each other. The two-frequency planar antenna includes a front conductor plate arranged on one surface of a dielectric substrate to serve as a radiation conductor plate of a resonant antenna and a slotted conductor of a slot antenna, a back conductor plate arranged on the other surface of the dielectric substrate to serve as a grounding conductor of the resonant antenna and a reflector of the slot antenna, and a slot antenna feed line embedded in the dielectric substrate. The slot antenna feed line is arranged along an axis where an electric field in an excitation mode of the resonant antenna is reduced to zero and at least one slot is formed in the front conductor plate along the feed line.

10 Claims, 2 Drawing Sheets

TWO-FREQUENCY SLOTTED PLANAR ANTENNA

BACKGROUND OF THE INVENTION

1. Field of the Invention

The present invention relates to planar antennas of the type in which radiating elements including conductor plates are provided on the surfaces of a dielectric substrate and more particularly to the construction of a two-frequency planar antenna which is operable at two different frequencies.

2. Description of the Related Art

There have been known planar antennas including a microstrip antenna and a slot antenna and such planar antennas of a two-frequency type have been proposed in the past for purposes of increasing the bandwidth.

A known type of two-frequency microstrip antenna has been so constructed that as disclosed in Japanese Patent Unexamined Publication No. 56-141605, a radiation conductor element composed of an elliptical conductor plate is arranged on one surface of a dielectric substrate whose other surface on the opposite side is covered with a grounding conductor plate, and a feeding point of the elliptical conductor plate is provided on a straight line where it is equidistant from the major and minor axes of the conductor plate. With the antenna of this construction, the elliptical radiation conductor element can be excited from the single feeding point into major-axis and minor-axis modes of different resonant frequencies which exist independently of each other thus providing a two-point resonant type frequency characteristic and allowing the operation at the two different frequencies.

On the other hand, a known slot antenna of the two-frequency type has been constructed so that as disclosed in Japanese Patent Unexamined Publication No. 58-54703, a slot is formed in a conductor deposited on one surface of a dielectric substrate whose other surface on the opposite side is provided with a pair of strip lines each crossing the slot near one of its ends and a branch filter is provided to feed power to each of the strip lines at one of two different frequencies. With this antenna, the length of the slot is selected equal to about half the wavelength at the higher one of the two frequencies, and also the slot is used as a minute slot for the lower frequency thereby allowing the antenna to operate at the two different frequencies.

Since both of these conventional antennas are of the construction in which the single radiating element is operated at the two different frequencies, the two operating frequencies cannot be selected by selecting them independently each other. Thus, in the case of the resonant microstrip antenna, it is possible to realize the selection of two frequencies in the form of values very close to each other, whereas in the case of the slot antenna, the determination of the higher one of the two frequencies naturally results in the determination of the lower frequency. Also, the same applies to the selection of gain, directivity, etc., and thus the conventional antennas have the disadvantage of extremely low degrees of freedom in the designing of antenna characteristics.

SUMMARY OF THE INVENTION

It is an object of the present invention to provide a two-frequency planar antenna which allows the designing of antenna characteristics having two operating points with high degrees of freedom without deteriorating the advantages of the planar antenna of being small in size, light in weight and thin in construction.

In accordance with the invention, there is provided a two-frequency planar antenna in which a resonant antenna and a slot antenna are formed in an superposed manner on the same dielectric substrate so as to be operable independently of each other. More specifically, it comprises a front conductor plate serving as a radiation conductor plate of a resonant antenna and a slotted conductor of a slot antenna, a back conductor plate serving as a grounding conductor of the resonant antenna and a reflector of the slot antenna, a dielectric substrate through which the front and back conductor plates are opposed, a resonant antenna feed line provided on the surface of the dielectric substrate and a slot antenna feed line embedded in the dielectric substrate. The slot antenna feed line is arranged along an axis where the electric field is reduced to zero in the excitation mode of the resonant antenna and the slots are formed in the front conductor plate along the slot antenna feed line. By virtue of this construction, the resonant antenna and the slot antenna arranged one upon another are independently operable without interferring with each other and this has the effect of considerably increasing the degree of freedom in the designing of antenna characteristics such as operating frequencies, gains and directivities for two-frequency planar antennas.

DESCRIPTION OF THE PREFERRED EMBODIMENTS

An embodiment of the invention will now be described in detail with reference to the drawings.

Figure 1:
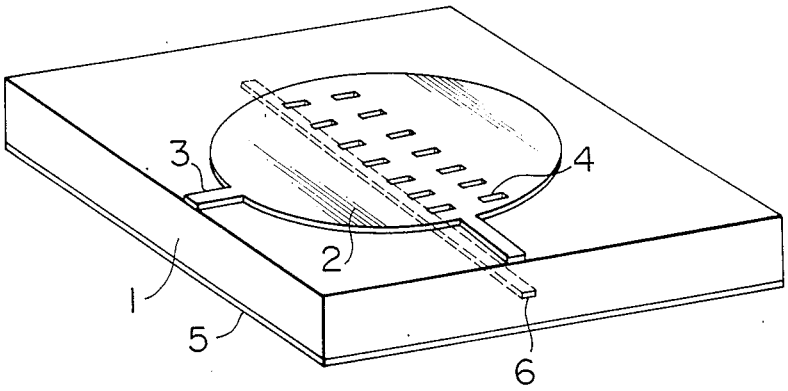
FIG. 1 is a perspective view showing an embodiment of a planar antenna according to the invention.

FIG. 1 is a perspective view showing the construction of an embodiment of the invention. In the Figure, numeral 1 designates a dielectric substrate in the form of a rectangular plate having wide-area first and second principal surfaces on its sides. Numerals 2 and 3 designate respectively a front conductor plate and a feed line which are deposited on the first principle surface of the dielectric substrate. The front conductor plate 2 is formed into a circular shape and a plurality of rectangular slots 4 are formed in substantially the central portion thereof. Numeral 5 designates a back conductor plate deposited on the second principal surface of the dielectric substrate 1 to oppose the front conductor plate 2 therethrough, and 6 a feed line embedded in the dielectric substrate 1. The plurality of slots 4 are arranged along the feed line 6.

Figure 2:
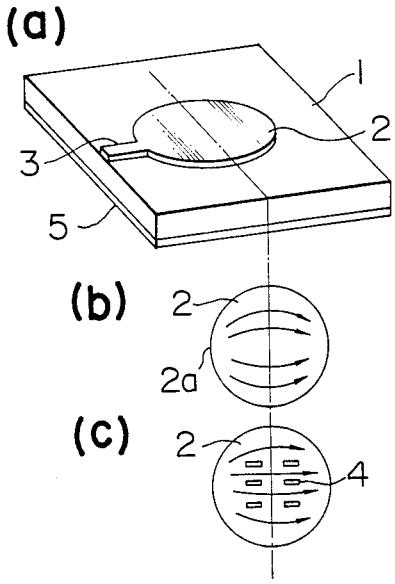
FIG. 2 illustrates a perspective view (a) for explaining the construction of the resonant antenna incorporated in the planar antenna of the invention and diagrams (b) and (c) are useful for explaining the operation thereof.
Figure 3:
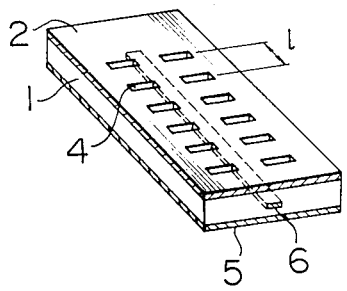
FIG. 3 is a perspective view for explaining the construction of the slot antenna incorporated in the planar antenna of the invention.

In this embodiment, the front and back conductor plates 2 and 5 are respectively used as a circular radiation conductor and a grounding conductor which are opposed through the dielectric substrate 1 and the feed line 3 is used as a feed line for supplying power to the radiation conductor thereby forming a resonant antenna as shown in (a) of FIG. 2. On the other hand, a slot antenna as shown in FIG. 3 is formed by using the front conductor plate 2 as the conductor plate deposited on the first principal surface of the dielectric substrate 1 and formed with the slots 4 serving as radiating elements, the back conductor plate 5 as a reflector and the feed line 6 as a feed line for supplying the power to the slots 4 through the dielectric substrate 1. It is to be noted that the front conductor plate 2 may be formed into any other shape than the circular shape such as an annular shape and its dimension is principally determined in relation with the operating frequency and excitation mode of the resonant antenna. Also, the longitudinal length of the slots 4 is selected to be substantially half the wavelength at the operating frequency of the slot antenna in consideration of the dielectric constant of the dielectric substrate 1 and the spacing l of the slots 4 can be principally determined by determining the direction of radiation (the beam tilt direction) of the slot antenna.

Then, the fact that the resonant antenna and the slot antenna are formed in a superposed manner on the dielectric substrate 1 through the use of the front and back conductor plates 2 and 5 in common gives rise to a problem of interaction (interference) between these antennas and its elimination requires the following construction. First, the slot antenna feed line 6 is arranged along an axis where the electric field within the resonant antenna is reduced to zero when the resonant antenna is excited. In other words, in this embodiment the excitation mode of the resonant antenna constitutes the basic mode (the $TM_{11}$ mode) so that in this case a current flows from a feeding point 2*a* traversely in the circular front conductor plate 2 as shown by the arrows in (b) of FIG. 2 and an axis of zero field is located longitudinally through the center of the circular front conductor plate 2 as shown by the dot-and-dash line. Therefore, the feed line 6 is embedded in the dielectric substrate 1 along this axis. Also, the slots 4 are arranged at given spaced intervals along the feed line 6 in the front conductor plate 2. It is to be noted that where the resonant antenna is used in any other excitation mode, it is only necessary to similarly arrange the slot antenna along an axis where the electric field is reduced to zero in this mode.

Figure 4:
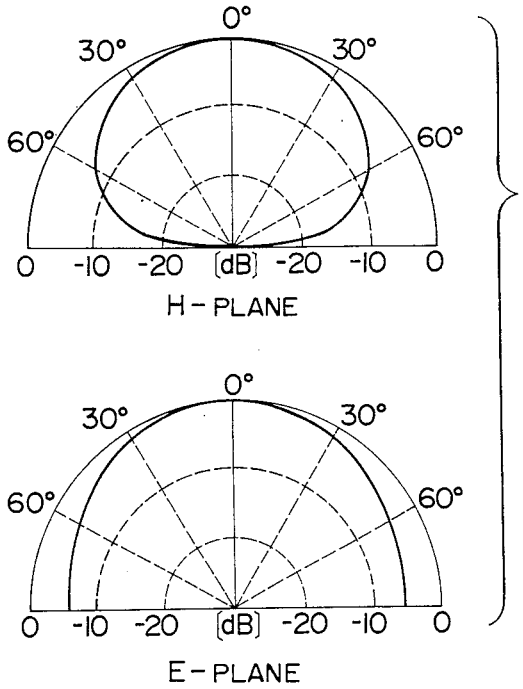
FIG. 4 shows field pattern diagrams showing the radiation directivity of the resonant antenna.
Figure 5:
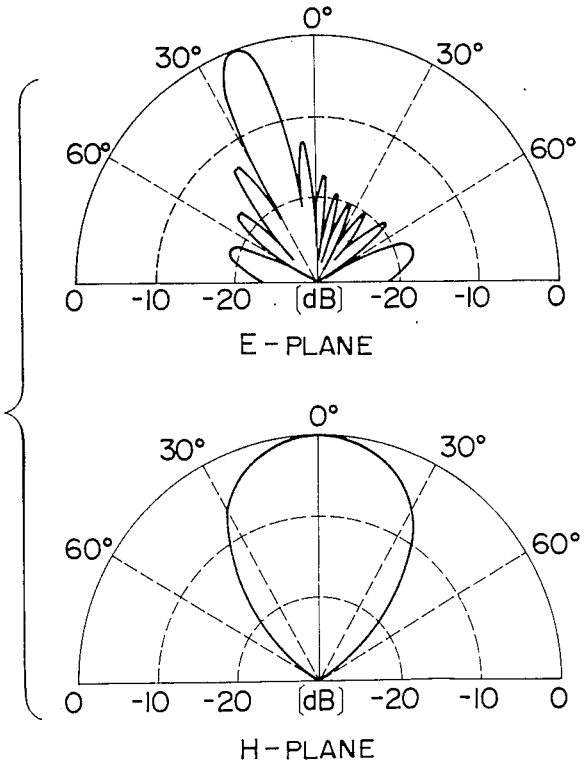
FIG. 5 shows field pattern diagrams showing the radiation directivity of the slot antenna.

With the embodiment constructed as mentioned above, by virtue of the fact that the slot antenna feed line 6 is embedded in the dielectric substrate 1 along the axis where the electric field in the resonant antenna is reduced to zero when it is excited in any given mode, the feed line 6 is located in a place where the electric field in the resonant antenna is essentially zero with the result that the feed line 6 has practically no effect on the resonant antenna and the electric field in the resonant antenna has practically no effect on the feed line 6. As a result, the resonant antenna and the slot antenna which are integrally arranged in an superposed manner, are allowed to operate independently of each other without any interference between their electric fields in the dielectric substrate 1. Also, the radiation directivities of the resonant antenna and the slot antenna are substantially the same as those obtained when they are provided separately as shown in FIGS. 4 and 5. Note that in this embodiment the direction of the main beam in the E-plane of the slot antenna is tilted 20 degrees from the vertical direction of the antenna. Then, while in the resonant antenna mode, the plurality of slots 4 are formed in the circular front conductor plate 2 forming the radiation conductor plate, the current flows in the longitudinal direction of the slots 4 as shown by the arrows in (c) of FIG. 2 and thus there is no danger of the slots 4 disturbing the current distribution in the front conductor plate 2. Also, in the case of any other excitation mode, the opening area of the slots 4 is so small as compared with the area of the front conductor plate 2 that the slots 4 serving as radiating elements do not have much effect on the current distribution in the front conductor plate 2.

Thus, the integral resonant and slot antennas are operable independently without interferring with each other and the operating frequencies of the antennas can be selected irrespective of each other. Thus, generally the resonant antenna is operable at a relatively low frequency and the slot antenna is operable at a relatively high frequency. Consequently, the antenna characteristics of a two-frequency antenna can be designed very freely. For instance, by constructing the antennas so that the resonant antenna is operated in the VHF or UHF band and the slot antenna is operated in the microwave X band (about 10 $GH_z$), it can be used as an automobile antenna or the like which is adapted for satellite communication purposes. Also, the slot antenna is generally used as an array antenna including a plurality of slots forming radiating elements and provided as in the present embodiment and the gain and the main beam direction can be determined as desired by suitably selecting the number of elements and the element spacing thus making it possible to realize antennas having a variety of characteristics.

Further, by virtue of the fact that the resonant antenna and the slot antenna are integrally formed by utilizing the greater parts of their constructions in common, the constructions of the resonant antenna and the slot antenna as individual antennas are not modified greatly and the advantages of this type of planar antenna of being small in size, light in weight and thin in construction are not lost.

We claim:

1. A two frequency planar antenna comprising:

dielectric substrate means having first and second surfaces;

front conductor plate means disposed on said first surface and having at least one slot with a slot longitudinal direction parallel to a first direction, for (a) providing a radiation conductor for a resonant antenna at one of said two frequencies, and for (b) providing a slotted conductor for a slotted antenna for the other one of said two frequencies;

first feed line means disposed on said first surface substantially parallel to said first direction, for supplying first frequency power to said front conductor plate means between said front conductor plate means and a ground conductor;

back conductor plate means disposed on said second surface for (a) providing said ground conductor for said resonant antenna, and for (b) providing a reflector for said slotted antenna; and second feed line means disposed inside said dielectric substrate means between said first and second surfaces, for providing second frequency power to said slotted antenna between said slotted antenna and said seconds feed line means, said second feed line means being arranged parallel to a second direction where an electric field of said resonant antenna is reduced to substantially zero in an excitation mode of said resonant antenna.

2. An antenna according to claim 1, wherein said slot is arranged along said second feed line.

3. An antenna according to claim 1, wherein said front conductor plate means has a circular shape.

4. An antenna according to claim 1, wherein said front conductor plate means has a rectangular shape.

5. An antenna according to claim 1, wherein said front conductor plate means has an annular shape.

6. An antenna according to claim 1, wherein said front conductor plate means has a size determined in accordance with an operating frequency and excitation mode of said resonant antenna.

7. An antenna according to claim 1, wherein an opening of said slot has a rectangular shape.

8. An antenna according to claim 1, wherein the opening of said slot is small in area as compared with said front conductor plate.

9. An antenna according to claim 1, wherein a longitudinal length of said slot is selected to be half a wavelength at an operating frequency of said slotted antenna.

10. An antenna according to claim 1, wherein a plurality of said slots are arranged at predetermined spaced intervals according to a direction of radiation of said slot antenna.

* * * * *